US008468862B2

(12) United States Patent
Ganesh

(10) Patent No.: US 8,468,862 B2
(45) Date of Patent: Jun. 25, 2013

(54) PEENING PROCESS FOR ENHANCING SURFACE FINISH OF A COMPONENT

(75) Inventor: Swami Ganesh, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 614 days.

(21) Appl. No.: 12/702,534

(22) Filed: Feb. 9, 2010

(65) Prior Publication Data

US 2011/0192205 A1 Aug. 11, 2011

(51) Int. Cl.
*C21D 7/06* (2006.01)
*B21C 37/30* (2006.01)

(52) U.S. Cl.
USPC ..... 72/53; 29/90.7

(58) Field of Classification Search
USPC ..... 72/53; 29/90.7
See application file for complete search history.

(56) References Cited

U.S. PATENT DOCUMENTS 3,073,022 A 1/1963 Bush et al.
4,454,740 A * 6/1984 Neal et al. ..... 72/53
4,514,469 A 4/1985 Loersch et al.
7,384,244 B2 6/2008 Broderick et al.
8,024,846 B2 * 9/2011 Luna et al. ..... 29/90.7
2005/0173028 A1 8/2005 Suda et al.
2006/0201650 A1 9/2006 Koyama et al.
2008/0221688 A1 9/2008 Trieu et al.
2009/0232428 A1 * 9/2009 Lu ..... 384/95

OTHER PUBLICATIONS

EP Search Report issued Apr. 28, 2011 in connection with corresponding EP Application No. 11153601.7.

* cited by examiner

*Primary Examiner* — Dana Ross
*Assistant Examiner* — Lawrence Averick
(74) *Attorney, Agent, or Firm* — Ernest G. Cusick; Gary M. Hartman; Domenica N. S. Hartman

(57) ABSTRACT

A process for treating a surface of a component to improve its surface finish and induce residual compresses stresses in a near-surface region of the component. The process entails performing a first peening operation to form residual compressive stress layers in the near-surface region of the component, and then performing at least a second peening operation to cause surface smoothing of the surface of the component while retaining residual compressive stresses in the near-surface region of the component. The first peening operation comprises wet glass bead peening at a first intensity with a first glass bead media, and the second peening operation comprises wet glass bead peening at a second intensity with a second glass bead media, wherein the second intensity is lower than the first intensity and the second glass bead media is smaller than the first glass bead media.

18 Claims, 3 Drawing Sheets

B - 100 Ra (average)
C - 25 Ra (average)
D - 53 Ra (average)
E - 46 Ra (average)
F - 52 Ra (average)

B - 100 Ra (average)
C - 25 Ra (average)
D - 53 Ra (average)
E - 46 Ra (average)
F - 52 Ra (average)

PEENING PROCESS FOR ENHANCING SURFACE FINISH OF A COMPONENT

BACKGROUND OF THE INVENTION

This invention relates to processes for modifying the surface of an article. More particularly, this invention is directed to peening processes by which mechanical properties and surface finish characteristics of a component can be improved.

Shot peening is a process by which the surface and immediate underlying substrate regions of a component can be modified to exhibit improved properties, including improved resistance to fatigue and foreign object damage by inducing compressive residual stresses. Certain components of turbomachinery, including airfoil components such as gas turbine blades, steam turbine blades, and gas turbine engine blades formed of steel, titanium-based alloys and superalloys, may require complete shot peening of their airfoil surfaces at relatively high intensities, for example, an Almen intensity of 10N on the Almen N strip scale (about 3A on the Almen A strip scale) or higher, to obtain the desired surface properties (all peening intensities referred to herein are quantified on either the Almen A or N strip scale). However, shot peening at high intensities tends to cause significant surface roughening of an airfoil surface, for example, about 90 microinches (about 2.3 micrometers) Ra and greater, which can be detrimental to blade aerodynamics and the overall performance of the turbine. Increased surface roughness also promotes the adhesion of airborne contaminants, corrodents, and erodents whose deposits can promote crevice pitting, stress corrosion cracking and fatigue loss.

In order to reduce roughness following peening, compressor blades often undergo a polishing process, such as prolonged tumbling, hydro-honing, drag finishing, chemical etching, or other methods to reduce the surface finish to more acceptable levels, for example, 35 microinches (about 0.9 micrometers) Ra. However, the resulting surface finish is often higher than the original pre-peened airfoil surface finish. In addition to increasing the production costs and cycle time, post shot-peen polishing processes can also negate the benefits obtained from shot peening by removing the compressive residual stress layers, and in so doing can also cause dimensional distortion.

BRIEF DESCRIPTION OF THE INVENTION

The present invention provides a process for treating a surface of a component to improve its surface finish and induce residual compressive stresses in a near-surface region of the component.

According to a first aspect of the invention, the process entails performing a first peening operation to form residual compressive stress layers in the near-surface region of a component, and then performing at least a second peening operation to cause surface smoothing of the surface of the component while retaining residual compressive stresses in the near-surface region of the component. The first peening operation comprises wet glass bead peening at a first intensity with a first glass bead media, and the second peening operation comprises wet glass bead peening at a second intensity with a second glass bead media, wherein the second intensity is lower than the first intensity and the second glass bead media is smaller than the first glass bead media.

According to a preferred aspect of the invention, the process achieves a smooth surface finish in the as-peened condition without the need for post-peen polishing processes that tend to remove the desirable residual compressive stress layers induced by the first peening operation and may cause dimensional distortion of the component. By eliminating the use of post-peen polishing, the invention is also capable of significantly reducing production time and costs of a component.

Other aspects and advantages of this invention will be better appreciated from the following detailed description.

DETAILED DESCRIPTION OF THE INVENTION

Figure 1:
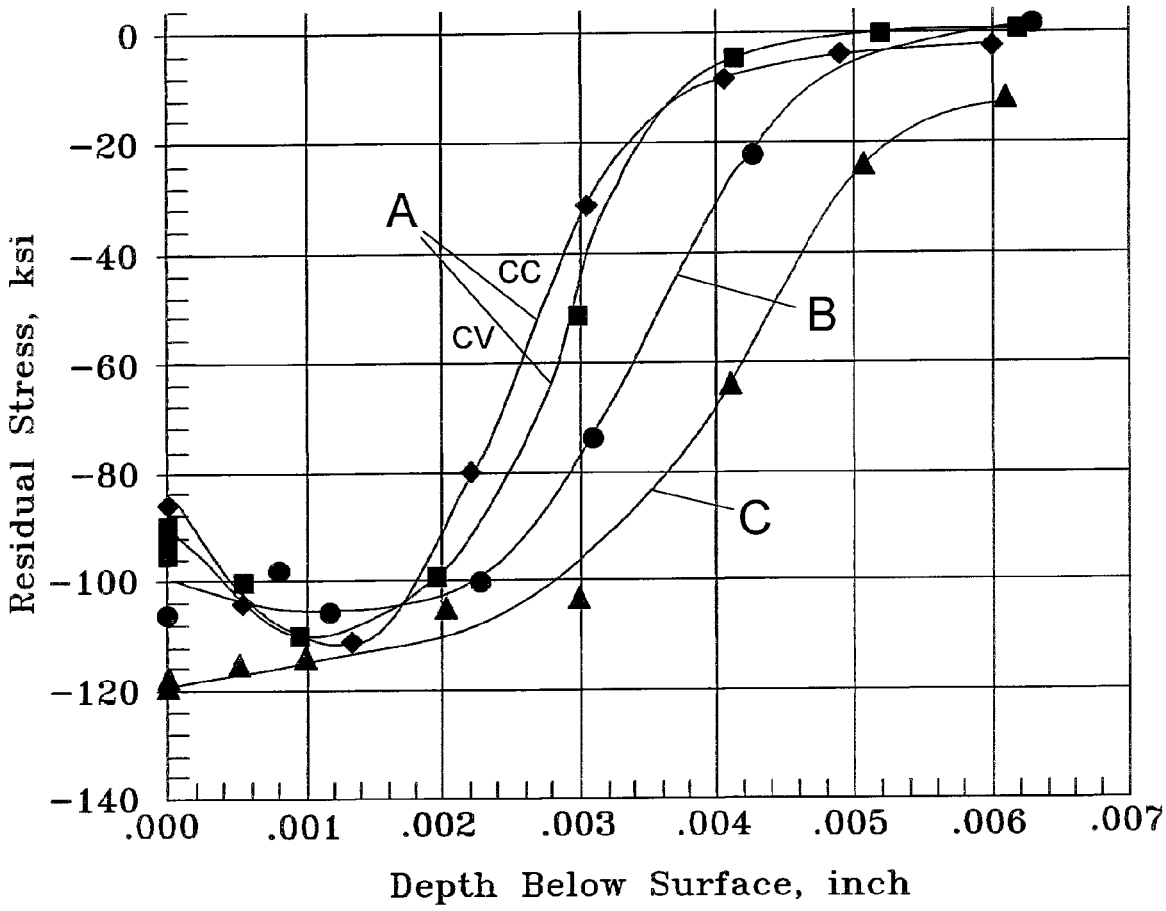
FIG. 1 is a graph plotting the case depth of residual compressive stresses induced by three surface treatments performed on gas turbine compressor blades.

The present invention is generally applicable to components that benefit from the effects of shot peening, including improved fatigue properties, but also require relatively smooth surface finishes of less than 35 microinches (about 0.9 micrometers) Ra, such as 25 microinches (about 0.6 micrometers) Ra or less, that are not achievable with conventional shot peening processes. Notable examples of such components include airfoil components of turbomachinery, including gas turbine blades, steam turbine blades, and gas turbine engine blades formed of steel, titanium-based alloys and superalloys, whose airfoils are subjected to high fatigue loads. While the advantages of this invention will be described with reference to compressor blades, the teachings of this invention are generally applicable to any component that benefits from smooth surface finishes and fatigue resistance.

The invention generally entails a peening process by which peening mediae of at least two different sizes are employed in sequence and in a manner that initially induces a desirable level of compressive residual stress layers in the near-surface region of a component, followed by surface smoothing without removing the desired compressive residual stresses. More particularly, the peening process is a wet glass bead peening process that involves wet glass bead peening performed at a first Almen intensity with a relatively coarse glass bead media, followed by another wet glass bead peening operation performed at a lower Almen intensity with a finer glass bead media. The first Almen intensity is preferably at least 7N, for example, 7N to 14N, and more preferably 9N to 12N, and the lower Almen intensity is preferably less than 6N, more preferably about one fourth to about one third of the first Almen intensity, for example, 2N to 5N. The glass bead mediae used to achieve the first and second intensities should have diameters as large as practical for the selected intensity range. The relatively coarse glass bead media for achieving the first intensity should have diameters of greater than 0.50 millimeter, as a nonlimiting example, about 0.70 millimeter (e.g., GP234 or equivalent), and the relatively finer glass bead media for achieving the lower intensity has smaller diameters, such as about one fourth to about one third of the relatively coarse glass bead media, as a nonlimiting example, about 0.2 millimeter (e.g., GP20 or equivalent). The first peening operation is intended to induce the desired compressive residual stress layers in the near-surface region of the blade, while the second peening operation is intended to cause surface smoothing by removing asperities created by the first peening operation. In addition to reduced process time and cost compared to conventional polishing processes, the second peening operation substantially retains the full benefits of the preceding peening operation and avoids the risk of part distortion associated with polishing processes.

An investigation leading to the invention was conducted with steel compressor blades of an industrial gas turbine. A first blade (Specimen A) underwent shot peening with CCW-14 stainless steel wire shot (diameter of about 0.014 inch (about 0.35 mm) at an Almen intensity of about 10 N to 12N, followed by a lengthy tumbling vibratory polish operation. A second blade (Specimen B) underwent the same peening operation as the first, but without the additional tumbling operation. Finally, a third blade (Specimen C) underwent wet glass bead peening with GP234 glass beads (diameter of about 0.028 inch (about 0.70 mm)) at an Almen intensity of about 9N to 12N, followed by wet glass bead peening with GP20 glass beads (diameter of about 0.008 inch (about 0.20 mm)) at an Almen intensity of about 3N. Each of the shot peening processes was carried out to achieve full surface coverage.

FIG. 1 is a graph plotting the case depth of residual compressive stresses induced by the three surface treatments, and evidences that higher residual compressive stresses were achieved at significantly greater case depths in the blade that underwent the two-step peening process. ("CC" and "CV" identify data obtained from the concave and convex surfaces, respectively, of Specimen A.) Notably Specimen C, which underwent the two-step peening surface treatment exhibited the highest residual compressive stresses throughout its entire near-surface region, which corresponded to a depth of about 0.006 inch (about 150 micrometers) below the surface of the blade. By comparing the data for Specimens A and B, it is evident that the tumbling operation had likely reduced the residual compressive stresses in Specimen A.

In a second investigation, three additional blades underwent two-step peening processes using different coarse peening mediae. A first of these additional blades (Specimen D) underwent wet glass bead peening with GP 165 glass beads (diameter of about 0.02 inch (about 0.50 mm)) to achieve full surface coverage and an Almen intensity of about 10 N. A second of these blades (Specimen E) underwent peening with S110 cast steel shot (diameter of about 0.014 inch (about 0.35 mm) or less) to achieve full surface coverage and an Almen intensity of about 10N, while the third blade (Specimen F) underwent peening with S170 cast steel shot (diameter of about 0.02 inch (about 0.50 mm)) to achieve full surface coverage and an Almen intensity of about 10N. The second peening step performed on Specimens D, E and F employed the same GP20 glass bead slurry, coverage, intensity (about 3N), and duration as used in the previous investigation.

Figure 2:
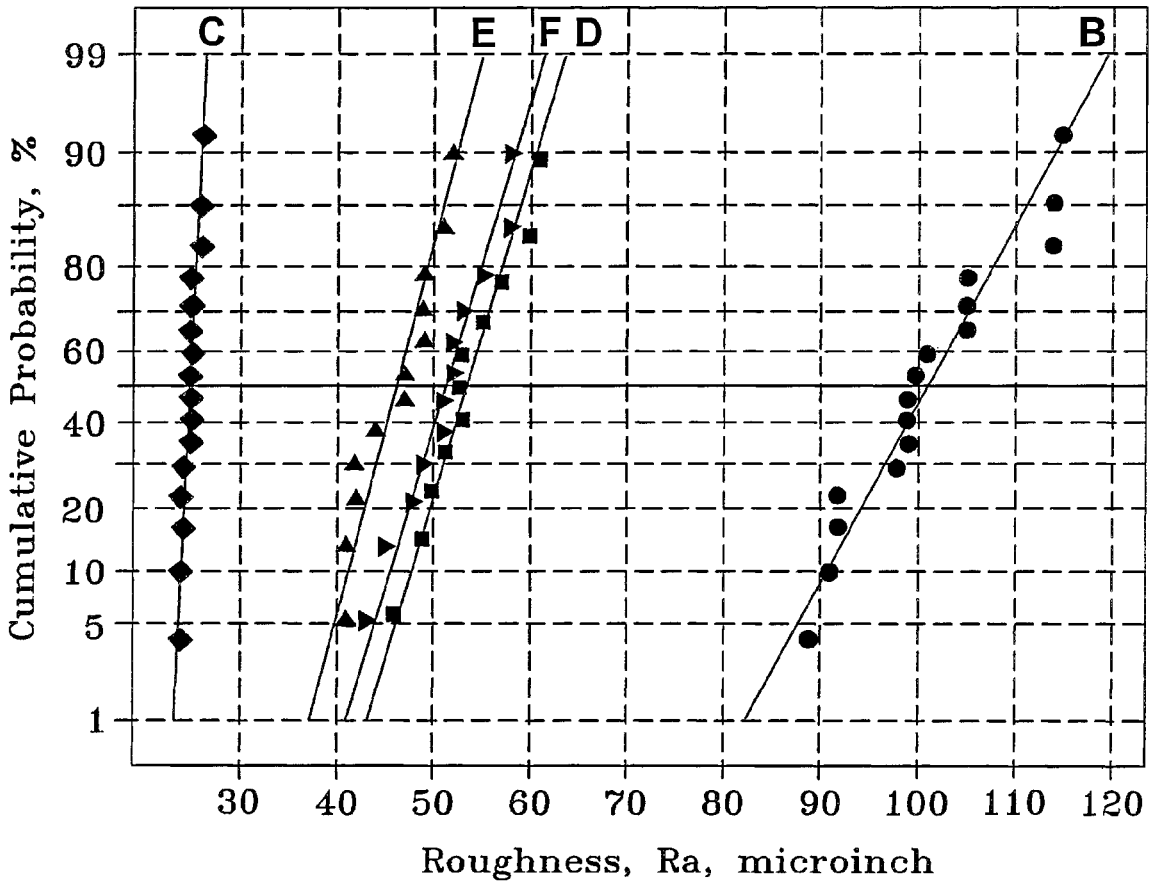
FIG. 2 is a graph plotting surface roughness data resulting from five different surface treatments performed on gas turbine compressor blades.
Figure 3:
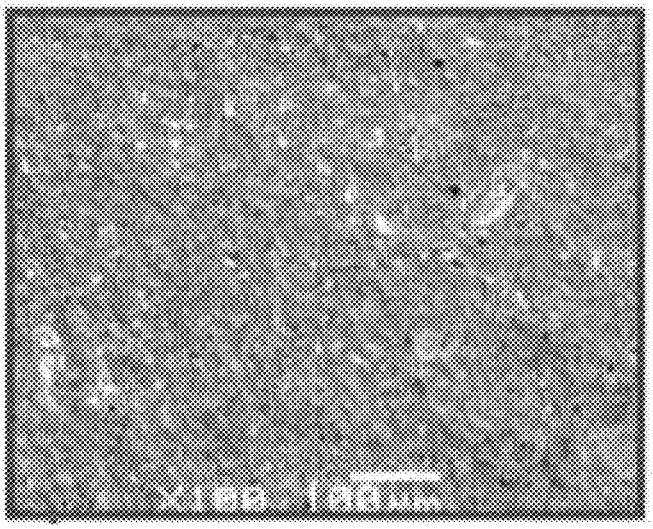
FIGS. 3 and 4 are scanned images of microphotographs showing the appearance of two surfaces of compressor blades whose data are represented in FIG. 2.
Figure 4:
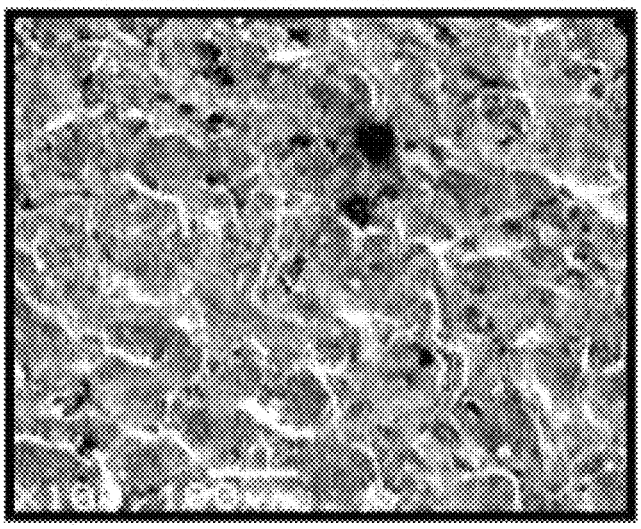

FIG. 2 is a normal probability plot of surface roughness data on a percentile basis for Specimens D, E and F of the second investigation, as well as Specimens B and C from the first investigation. From this graph, it is evident that the surface finish attainable with the GP20 glass bead slurry was dependent on the media used in the first peening operation, and that far better surface finishes were attained when the first peening operation employed the larger GP234 glass beads (diameter of about 0.70 mm), as opposed to the finer GP165 glass beads (diameter of about 0.50 mm) and either of the cast shot mediae (diameters of about 0.35 and 0.50 mm). The mean surface finish of the unpolished Specimen B (peened with CCW-14 stainless steel wire shot (about 0.35 mm diameter; Almen intensity of about 10N to 12N; no tumbling or second peening operation) was about 100 microinches (about 2.5 micrometers) Ra, whereas the mean surface finishes for Specimen E peened with S110 cast shot (0.35 mm diameter), Specimen F peened with S170 cast steel shot (0.50 mm diameter), and Specimen D peened with GP 165 glass beads (0.50 mm diameter) were within a range of about 46 to 53 microinches (about 1.2 to about 1.3 micrometers) Ra. In contrast Specimen C, which underwent a two-step peening operation (GP234 glass beads (0.70 mm diameter) at an intensity of 9N to 12N, followed by the smaller GP20 glass beads at an intensity of 3N), had a mean surface finish of about 25 microinches (about 0.64 micrometers) Ra. FIGS. 3 and 4 are scanned images of microphotographs showing the appearance of the airfoil surfaces of Specimens C and B, respectively, and evidence the drastic improvement in surface finish achieved with the second peening operation performed on Specimen C.

From the above, it was concluded that a two-step peening process can achieve desirable levels of residual compressive stresses and surface roughnesses of about 25 microinches (about 0.64 micrometers) and less by employing a first slurry containing a glass bead media of greater than 0.50 millimeter particles, followed by a second peening operation at a lower intensity using a second slurry containing a finer glass bead media. More generally, it was concluded that the glass bead mediae used to achieve the intensities of the first and second peening operations should have diameters as large as practical for their respective intensities. As examples, for components such as gas turbine compressor blades formed of steel alloys, titanium-based alloys and superalloys, it is believed that the first wet glass bead peening operation should preferably be performed using a relatively coarser glass bead media having diameters of greater than 0.50 mm to about 0.90 mm, more preferably about 0.60 to about 0.80 mm, and achieve an Almen intensity of at least 7N and to about 14N, more preferably about 9N to about 13N, and the second glass bead peening operation should preferably be performed at an Almen intensity of less than 6N, more preferably about one fourth to about one third of the first Almen intensity, for example, 2N to 5N, using a smaller glass bead media than the first, preferably about one fourth to about one third of the relatively coarse glass bead media, for example, about 0.15 to about 0.25 mm. According to a preferred aspect of the invention, the surface finish following the second peening operation is about one fourth to about one half the surface finish following the first operation, for example, if the surface roughness after the first peening operation is about 70 to about 100 microinches (about 1.8 to about 2.5 micrometer), the second peening operation is carried out to achieve a surface finish of about 20 to about 50 microinches (about 0.5 to about 1.3 micrometer).

While the invention has been described in terms of a preferred embodiment, it is apparent that other forms could be adopted by one skilled in the art. For example, while glass bead mediae are preferred it is foreseeable that different materials could be used, such as ceramic, steel, stainless, etc., though doing so would necessitate adjustments in media size and intensities. Furthermore, it should be noted that various peening techniques may be used if capable of delivering the peening mediae at the specified intensities while also providing the necessary coverage for the surface area to be treated. Therefore, the scope of the invention is to be limited only by the following claims.

The invention claimed is:

1. A peening process for enhancing a surface finish of a component, the process comprising the steps of:

performing a first peening operation to form residual compressive stress layers in a near-surface region of the component, the first peening operation comprising wet glass bead peening at a first intensity with a first glass bead media; and then performing at least a second peening operation to cause surface smoothing of the surface of the component while retaining residual compressive stresses in the near-surface region of the component, the second peening operation comprising wet glass bead peening at a second intensity with a second glass bead media, wherein the second intensity is about one fourth to about one third of the first intensity and glass beads of the second glass bead media have diameters of about one fourth to about one third of the diameters of the first glass bead media.

2. The process according to claim 1, wherein glass beads of the first glass bead media have diameters of greater than 0.50 millimeter.

3. The process according to claim 1, wherein glass beads of the first glass bead media have diameters of greater than 0.50 millimeter to about 0.90 millimeter.

4. The process according to claim 1, wherein glass beads of the first glass bead media have diameters of about 0.60 to about 0.80 millimeter.

5. The process according to claim 1, wherein the first intensity of the first peening operation is about 7N to about 14N.

6. The process according to claim 1, wherein the first intensity of the first peening operation is about 9N to about 13N.

7. The process according to claim 1, wherein the first intensity of the first peening operation is about 10N to about 12N.

8. The process according to claim 1, wherein glass beads of the second glass bead media have diameters of about 0.15 millimeter to about 0.25 millimeter.

9. The process according to claim 1, wherein the second intensity of the second peening operation is less than 6N.

10. The process according to claim 1, wherein the second intensity of the second peening operation is about 2N to about 5N.

11. The process according to claim 1, wherein the surface finish of the surface of the component following the second peening operation is about one fourth to about one half the surface finish following the first peening operation.

12. The process according to claim 1, wherein the surface finish of the surface of the component following the first peening operation is about 1.8 to about 2.5 micrometer, and the surface finish following the second peening operation is about 0.5 to about 1.3 micrometer.

13. The process according to claim 1, wherein the surface finish of the surface of the component following the second peening operation is less than 0.9 micrometer.

14. The process according to claim 1, wherein the component is formed of a material chosen from the group consisting of steel alloys, titanium-based alloys and superalloys.

15. The process according to claim 1, wherein the component is an airfoil component of a turbomachine.

16. The process according to claim 15, wherein the airfoil component is chosen from the group consisting of gas turbine blades, steam turbine blades, and gas turbine engine blades and the surface of the component is an airfoil surface.

17. The process according to claim 1, wherein the first and second peening operations are the only peening operations performed on the component.

18. A peening process for enhancing a surface finish of an airfoil surface of a turbomachine component, the process comprising:

performing a first peening operation to form residual compressive stress layers in a near-surface region of the component, the first peening operation comprising wet glass bead peening at an intensity of 7N to 14N with a first glass bead media consisting of glass beads having diameters of greater than 0.50 millimeter; and then performing a second peening operation to cause surface smoothing of the surface of the component while retaining residual compressive stresses in the near-surface region of the component, the second peening operation comprising wet glass bead peening at an intensity of about one fourth to about one third of the intensity of the first peening operation with a second glass bead media consisting of glass beads having diameters of about one fourth to about one third of the first glass bead media, the surface finish of the airfoil surface following the second peening operation being 0.9 micrometer or less.

* * * * *